US007908677B1

(12) United States Patent
Montgomery

(10) Patent No.: US 7,908,677 B1
(45) Date of Patent: Mar. 22, 2011

(54) INSERT PANEL FOR PANTS

(76) Inventor: LaTonya Montgomery, Gouvernuer, NY (US)

( * ) Notice: Subject to any disclaimer, the term of this patent is extended or adjusted under 35 U.S.C. 154(b) by 403 days.

(21) Appl. No.: 12/131,857

(22) Filed: Jun. 2, 2008

(51) Int. Cl.
*A41D 9/00* (2006.01)
*A41D 3/02* (2006.01)

(52) U.S. Cl. ..... 2/338; 2/235

(58) Field of Classification Search ..... 2/227, 229, 2/234, 235, 236, 237, 311, 312, 329, 336, 2/337, 338, 244, 67
See application file for complete search history.

(56) References Cited

U.S. PATENT DOCUMENTS 871,213 A * 11/1907 Eckmann ..... 602/73
1,229,850 A * 6/1917 Zetosch ..... 602/68
1,313,165 A * 8/1919 Casselman ..... 602/73
1,693,141 A * 11/1928 Ducat ..... 2/240
2,606,322 A * 8/1952 Vraciu ..... 450/149
2,709,262 A * 5/1955 Jacobs et al. ..... 2/221
2,719,973 A * 10/1955 Blatt ..... 450/155
2,873,452 A * 2/1959 Jacobs ..... 2/221
3,335,721 A * 8/1967 Gastwirth ..... 604/391
3,547,117 A * 12/1970 Smithers ..... 602/70
3,793,645 A * 2/1974 Kadison ..... 2/221
3,880,160 A * 4/1975 Hall ..... 602/70
4,028,740 A * 6/1977 Luerken ..... 2/67
4,121,305 A * 10/1978 Kolker ..... 2/406
4,122,849 A * 10/1978 Dietz ..... 602/73
4,303,187 A * 12/1981 Berman ..... 224/222
4,356,943 A * 11/1982 Berman ..... 224/222
D279,141 S * 6/1985 Poland ..... D2/632
4,580,298 A * 4/1986 Tuisl ..... 2/237
4,803,740 A * 2/1989 Dawson ..... 2/215
4,998,653 A * 3/1991 LaBelle ..... 224/578
5,003,972 A * 4/1991 Kestler ..... 602/70
5,163,184 A * 11/1992 Reardon ..... 2/237
5,193,225 A * 3/1993 Karami et al. ..... 2/312
5,217,403 A * 6/1993 Nobbs ..... 450/155
5,283,910 A * 2/1994 Flint ..... 2/76
5,285,833 A * 2/1994 Haxby ..... 150/102
5,295,267 A * 3/1994 Galindo ..... 2/466
5,524,298 A * 6/1996 Plunkett ..... 2/403
5,528,775 A * 6/1996 Marenda ..... 2/406
5,547,466 A * 8/1996 McRoberts et al. ..... 602/70
5,575,011 A * 11/1996 Allen ..... 2/227
5,807,299 A * 9/1998 McRoberts et al. ..... 602/67
5,876,395 A * 3/1999 Hart et al. ..... 604/393
5,946,730 A * 9/1999 Blair ..... 2/227
5,991,920 A * 11/1999 Holland ..... 2/67
6,132,412 A * 10/2000 Jones ..... 604/400
6,159,070 A * 12/2000 Schwartz et al. ..... 450/155
6,219,848 B1 * 4/2001 Russell ..... 2/221
6,334,223 B1 * 1/2002 Pieri ..... 2/455
6,620,026 B1 * 9/2003 Guilani et al. ..... 450/155
37,987 A1 * 1/2004 Holland ..... 2/67

(Continued)

*Primary Examiner* — Alissa L Hoey
(74) *Attorney, Agent, or Firm* — Stephen Powers

(57) ABSTRACT

A maternity pant insert that is configured to allow a user wear a conventional size pair of pants during the phases of pregnancy. The pant insert includes a main panel that is generally rectangular in shape and is of sufficient size to cover the opening in the front region of the pant created by the user being unable to utilize the fasteners integrally mounted on the pant. A waist strap is connected to the main panel and is configured to operably connect with the belt loops of the pant. Mounted on the waist strap are a plurality of fasteners located on opposing sides of the main panel that function to allow a user to releasably secure the pant insert to the pant.

6 Claims, 2 Drawing Sheets

U.S. PATENT DOCUMENTS

| | | | | |
|---|---|---|---|---|
| 6,738,988 | B2 * | 5/2004 | Ruiter et al. | 2/400 |
| 6,817,038 | B2 * | 11/2004 | Blanco | 2/406 |
| D503,508 | S * | 4/2005 | Hooker et al. | D2/627 |
| 7,181,775 | B2 * | 2/2007 | Carney | 2/311 |
| D579,628 | S * | 11/2008 | Wiens | D2/711 |
| 7,676,852 | B1 * | 3/2010 | Carney | 2/311 |
| 7,716,755 | B1 * | 5/2010 | Wiens | 2/466 |
| D619,780 | S * | 7/2010 | Hooker et al. | D2/627 |
| 2001/0046661 | A1 * | 11/2001 | Shorter | 434/395 |
| 2003/0183313 | A1 * | 10/2003 | Rushlow | 150/134 |
| 2004/0049834 | A1 * | 3/2004 | Stangle et al. | 2/338 |
| 2004/0163159 | A1 * | 8/2004 | Edwards et al. | 2/338 |
| 2004/0210987 | A1 * | 10/2004 | Carney | 2/236 |
| 2005/0039244 | A1 * | 2/2005 | Goldfarb et al. | 2/338 |
| 2005/0177931 | A1 * | 8/2005 | Tsujimoto | 2/466 |
| 2008/0040830 | A1 * | 2/2008 | Holland | 2/67 |
| 2008/0172769 | A1 * | 7/2008 | Herget | 2/76 |
| 2008/0184452 | A1 * | 8/2008 | Smaczny | 2/67 |
| 2008/0190980 | A1 * | 8/2008 | Overton | 224/664 |
| 2008/0276353 | A1 * | 11/2008 | Franko | 2/406 |
| 2008/0295217 | A1 * | 12/2008 | Hendrickson et al. | 2/69 |
| 2009/0049583 | A1 * | 2/2009 | Stones | 2/221 |
| 2009/0049584 | A1 * | 2/2009 | Stones | 2/221 |
| 2009/0139014 | A1 * | 6/2009 | Trochlil-Crist | 2/338 |
| 2009/0205100 | A1 * | 8/2009 | Flower et al. | 2/67 |
| 2009/0210996 | A1 * | 8/2009 | Hu | 2/228 |

* cited by examiner

INSERT PANEL FOR PANTS

FIELD OF THE INVENTION

The present invention relates to an insert panel for pants, more specifically but not by way of limitation, an insert panel that functions to cover a gap in the front region of the pant created when a user can not fasten the top portion of the pant with the integrated fasteners of the pant as a result of the user's waist size exceeding the waist size of the pant.

BACKGROUND

Traditional pants or jeans are manufactured in a plurality of sizes to accommodate a certain waist size of the wearer. Typically, the pants or jeans are manufactured in size intervals that can accommodate waist sizes within approximately an inch. During pregnancy, a woman's abdomen undergoes significant size changes. Inevitably, during the later trimester's, a woman will not be able to fit into a conventional jean or pant.

Inevitably the pregnant woman will need to acquire a new wardrobe in order to accommodate her body size during the latter phases of pregnancy. The pregnant women will not only need a different size pant or jean to accommodate their body changes during pregnancy but also to accommodate their body changes after birth while re-attaining their normal size. Currently, a woman must purchase specially designed pants or jeans once their body has changed size. Typically, these pants or jeans have an area that has been removed or is made of a different material from the rest of the garment in order to accommodate the extended abdomen region of the pregnant woman. These garments can be expensive and in addition they require a lengthy top so as to cover the upper area as it is manufactured from a different material than the rest of the garment.

Another issue with current maternity garments is that the material utilized to accommodate the abdomen region of the pregnant woman's body offers little support. The material is usually a different color than the rest of the jean or pant and is aesthetically unpleasing.

Accordingly, there is a need for a pant insert that will allow a pregnant woman to utilize their current wardrobe that will provide a more cost effective solution than purchasing specialized pants. Additionally, the pant insert will be manufactured from a plurality of materials in order to allow the user to match the color and texture of her pant.

SUMMARY OF THE INVENTION

It is the object of the present invention to provide a pant insert that will allow a pregnant woman to wear a traditional pant or jean.

It is a further object of the present invention to provide a pant insert that is the same color and material of the pant or jean to which it is releasably secured.

Yet another object of the present invention is to provide a pant insert that will allow a pregnant woman to wear a traditional size pant or jean that has an expandable waist strap in order to accommodate the different sizes of the waist during the phases of pregnancy.

Still another object of the present invention is to provide a pant insert that has a removable main panel in order to allow the user to match the color and texture of jean or pant that she is wearing.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
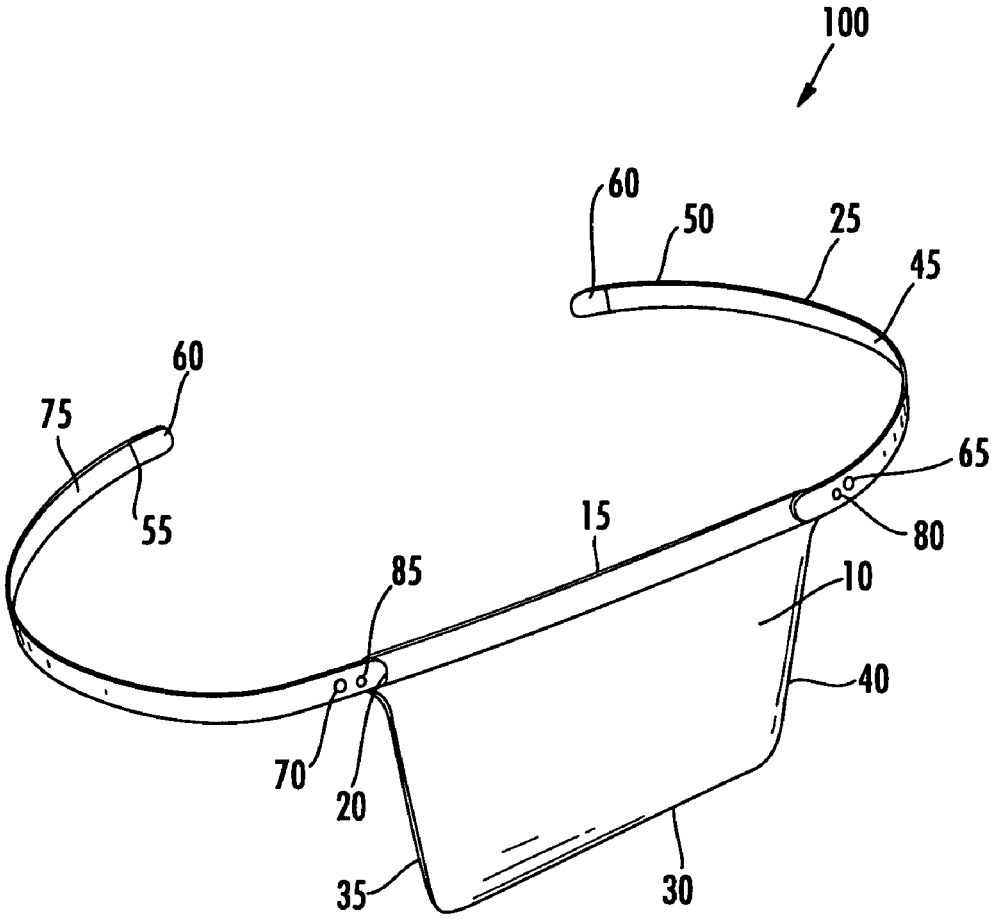
FIG. 1 is a perspective view of the pant insert.

Referring now to the drawings submitted herewith, wherein various elements depicted therein are not necessarily drawn to scale and wherein throughout the views and figures like elements are referenced with identical reference numerals, there is illustrated a pant insert 100 constructed according to the principles of the present invention.

Figure 3:
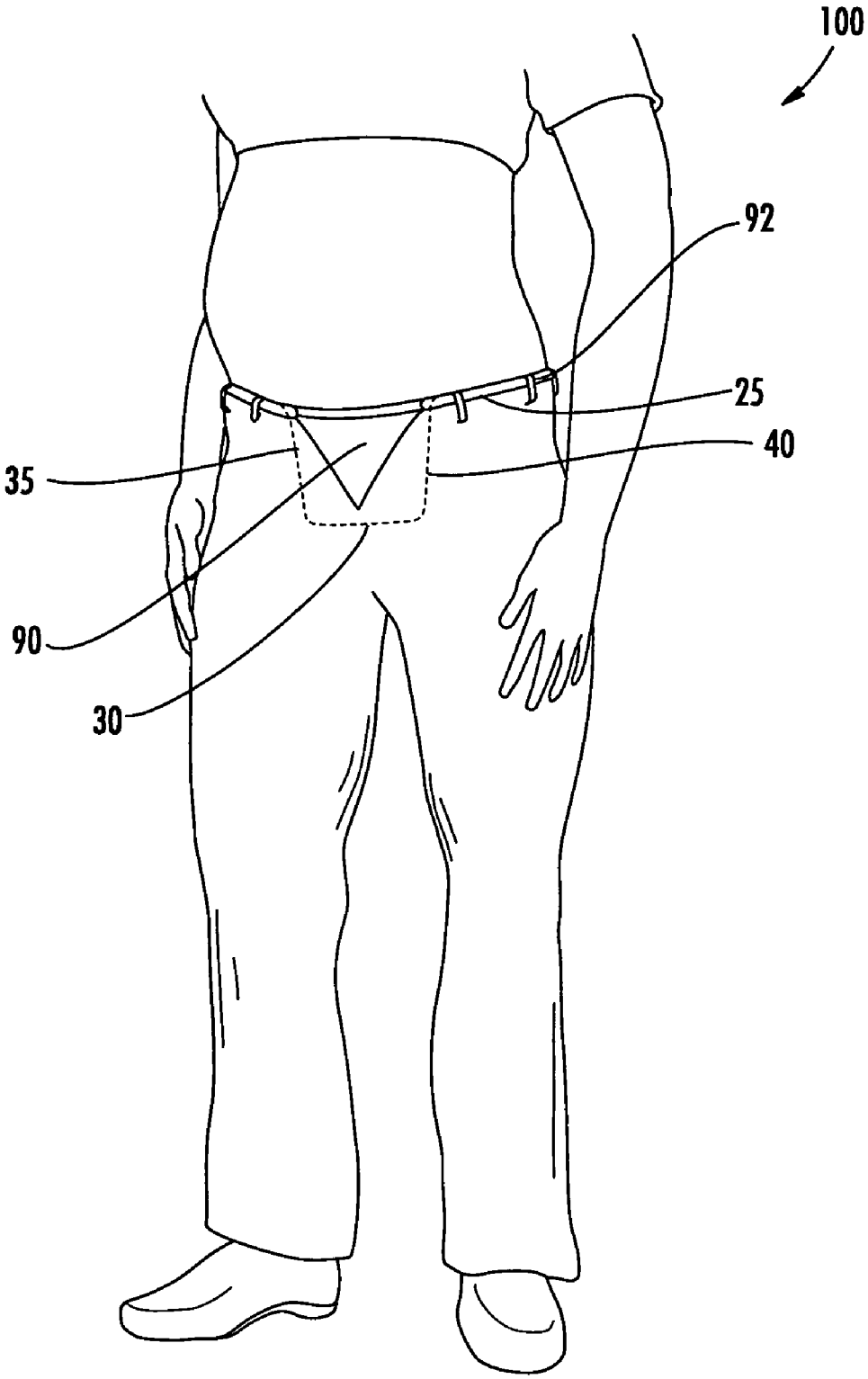
FIG. 3 is a perspective view of a user wearing a pant insert.

Referring in particular to FIGS. 1 and 3, the pant insert 100 comprises a main panel 10 that is generally rectangular in shape. The main panel 10 is manufactured from a suitable durable material such as but not limited to cotton or polyester. The main panel 10 functions to cover the opening 90 created in the front region of a pair of pants when worn by a user that can not fasten the pant utilizing the fasteners integral to the pant due to the size of the waist of the user exceeding the size of the waist of the pant. Those skilled in the art should recognize that the main panel 10 could be manufactured in numerous different sizes and shapes in order to substantially cover the opening 90 on a pair of pants of a user.

Proximate the upper edge 15 of the main panel 10 is a slot 20. The slot 20 functions to allow the main panel 10 to be releasably secured to the waist strap 25. The slot 20 is manufactured to accommodate the waist strap 25 such that the waist strap 25 can be journaled through the slot 20 allowing the user to change the main panel 10 of the pant insert 100. Subsequent, to being placed in position along the waist strap 25 the main panel 10 is releasably secured to the waist strap 25 utilizing suitable mechanical methods such as but not limited to buttons. It is contemplated within the scope of the present invention that the slot 20 could be sized so as to accommodate waist straps 25 of a plurality of different widths.

When releasably secured to the waist strap 25, the main panel 10 generally extends in a downward direction with the bottom edge 30 extending at least partially beyond the opening 90 in the frontal region of the pant being worn by the user. The opposing lateral edges 35, 40 of the main panel 10 extend laterally beyond the opening 90 in the frontal region of the pant. It should be recognized by those skilled in the art that the main panel 10 could be manufactured in numerous different colors and manufactured from numerous different materials in order for the user to be able to match the main panel 10 of the pant insert 100 to the pant that the user is wearing.

A waist strap 25 is releasably secured to the main panel 10. The waist strap 25 is comprised of a body 45 that is generally elongated in shape and being of appropriate width such that the waist strap 25 can be journaled through the slot 20 of the main panel 10. Furthermore, the waist strap 25 is manufactured such that it can be accommodated by a plurality of different size belt loops 92 integrally mounted on pants. The waist strap 25 is manufactured of a durable resilient material in order to allow a user to stretch the waist strap 25 around their waist and accommodate a plurality of waist sizes. The waist strap 25 functions to assist in supporting the pants on the user. The waist strap 25 further includes a first surface 75 and a second surface 77. It is contemplated within the scope of the present invention that the first surface 75 and second surface 77 could be manufactured in numerous different colors and textures such that the waist strap 25 could be reversibly mounted by the user.

The waist strap 25 has a first end 50 and a second end 55 that are distally located from each other. Proximate the first end 50 and the second end 55 are fasteners 60. The fasteners 60 function to allow the user to releasably secure the first end 50 to the second end 55 once the user has circumvented the waist strap 25 around their waist while journaling the waist strap 25 through the belt loops 92 integrally mounted on the pant. Although no particular type of fastener 60 is required, it is contemplated within the scope of the present invention that the fasteners 60 are manufactured from hook and loop material. It is further contemplated within the scope of the present invention that the waist strap 25 could be manufactured in numerous different sizes in order to accommodate a plurality of waist sizes.

Figure 2:
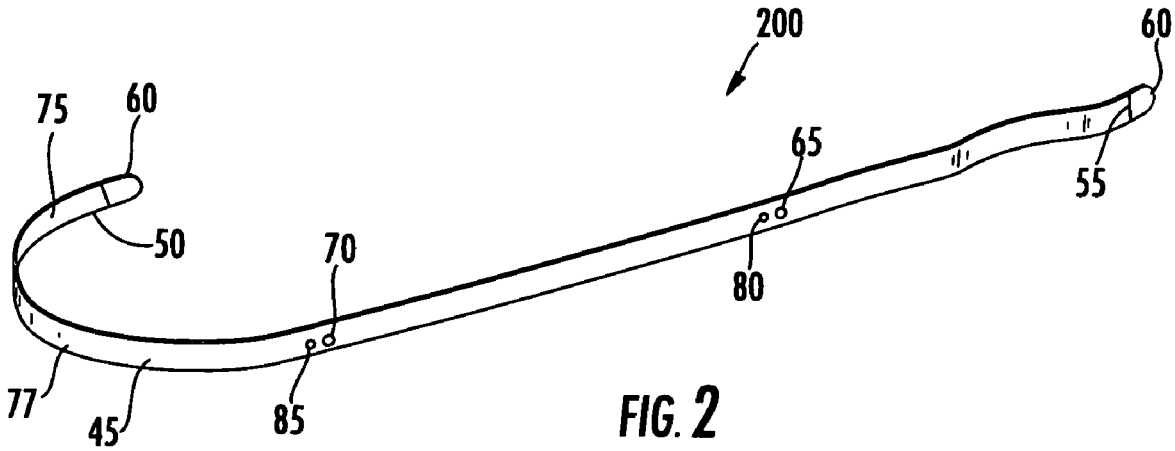
FIG. 2 is a perspective view of the waist strap.

Referring in particular to FIGS. 1 and 2, proximate the lateral edge 40 integrally mounted with the waist strap 25 is a first aperture 65. A conventional pair of pants or jeans typically has mounted thereon a button and mateable aperture utilized to secure the top portion the pant or jean to the user. When a user's waist exceeds the size of the waist of the pant, the integrated button and slot on the pant can no longer be utilized by the user to secure the top portion of the pant. The first aperture 65 is manufactured in a slot like configuration in order to receive therein a conventional button that is integrally mounted to most types of pants or jeans.

A second aperture 70 integrally mounted to the waist strap 25 proximate the lateral edge 35 of the main panel 10 is configured to engage with a conventional button of a pant or jean. Utilizing a first aperture 65 and a second aperture 70 on opposing sides of the main panel 10 allows the user to accommodate a button integrally mounted on the pant in opposing orientations. This configuration further allows the user to mount the waist strap 25 in a reverse orientation to display either the first surface 75 or second surface 77.

Proximate the first aperture 65 is a first fastener 80. The first fastener 80 is configured to be releasably secured to the conventional slot integrated into conventional pants. As previously mentioned herein, most pants have integrated thereon a button and a mateable slot in order to releasably secure the top portion of the pant to the user around the user's waist. Subsequent to the user's waist exceeding the waist size of the pant, such as during pregnancy, the first fastener 80 integrally mounted to the waist strap 25 will be utilized to releasably secure the mateable slot of the pant upon being proximate thereto. This allows the user to secure the pant around their waist without mateably connecting the fastening mechanism integrally mounted on the pant.

Integrally mounted on the waist strap 25 proximate the second aperture 70 is a second fastener 85. The second fastener is configured to be releasably secured to a conventional slot located on the top portion of the pant integrated to mateably connect to an opposing button. The second fastener 80 further allows a user to secure the waist strap 25 to the pant on the opposing side of the opening 90. While it is contemplated within the scope of the present invention that the first and second aperture 65, 70 and the first and second fastener 80, 85 are mateable halves of conventional buttons configured to engage with conventional buttons and slots typically integrated into pants or jeans, it is further contemplated within the scope of the present invention that there could exist numerous different configurations. More specifically but not by way of limitation, the waist strap 25 could have mounted thereon mateable portions of conventional snaps or hook and slide fasteners. It is also contemplated within the scope of the present invention that a plurality of different types and amounts of apertures 65,70 and/or fasteners 80,85 could be mounted along the waist strap 25 in order to accommodate a plurality of different fasteners utilized on conventional pants.

Referring in particular to FIGS. 1 and 3, a description of the operation is as follows. In use, a user will dress themselves in a pair of desired pants. Subsequent to dressing in the desired pants and being unable to fasten the top portion of the pants around their waist utilizing the integral fasteners of the pants the user will secure the pant insert 100 to the pant. The main panel 10 is secured to the waist strap 25 via the slot 20. The first end 50 of the waist strap 25 is journaled through the belt loops 92 of the pant. The main panel 10 is positioned to substantially cover the opening 90 in the frontal region of the pant. The second end 55 is journaled through the belt loops 92 on the opposing side of the pant. The fasteners 60 on the first end 50 and second end 55 are releasably secured to each other proximate the middle of the user's back. The user then secures the proximate fastener integrally mounted to the pant to the opposing mateable first aperture 65 or first fastener 80 integrally mounted to the waist strap 25. Following the securing of the waist strap 25 to one side of the top portion of the pant, the user then secures the opposing side of the top portion of the pant proximate the main panel 10 with the second aperture 70 or second fastener 85 utilizing the appropriate fastener integrally mounted to the pant.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A pant insert configured to substantially cover an opening in the front region of a pair of pants being worn by a user comprising:

a main panel, said main panel being generally rectangular in shape, said main panel being of appropriate size in order to substantially cover the opening in the front region of a user's pant;

a waist strap, said waist strap connected to said main panel, said waist strap configured to circumvent the user's waist and engage with belt loops of the pant in order to at least partially secure the pants to the user, said waist strap including a first aperture and a second aperture, said first aperture and said second aperture being integrally mounted on said waist strap wherein said main panel is intermediate thereto, said first and second aperture being configured to receive a proximate button mounted on the pant;

said waist strap including a first and second fastener, said first and second fastener being mounted to said waist strap proximate said first and second aperture wherein said main panel is intermediate said first and second fastener, said first fastener and said second fastener being configured to mateably connect to the pant;

said waist strap including a first end and a second end, said first end and said second end being configured to releasably secure to each other subsequent said waist strap being disposed around the waist of the user; and a slot, said slot being integrally mounted on the top portion of said main panel, said slot configured to releasably secure said main panel to said waist strap.

2. The pant insert as recited in claim 1, wherein said waist strap is configured to expand in order to accommodate a plurality of waist sizes of the user.

3. The pant insert as recited in claim 2, wherein said first fastener and said second fastener are buttons.

4. A pant insert configured to substantially cover an opening in the front region of a pair pants being worn by a user created when the waist of the user exceeds the size of the top portion of the pant such that the integrated fasteners of the pant can not be secured to one another comprising:

a main panel, said main panel being generally rectangular in shape, said main panel further including a bottom edge that extends beyond the opening in the front region of the pant, said main panel further having lateral edges that extend beyond the opening in the front in the front region of the pant, said main panel being configured to substantially cover the opening in the front region of the pant of the user;

a waist strap, said waist strap connected to said main panel, said waist strap configured to circumvent the user's waist and engage with belt loops of the pant in order to secure the top portion of the pants to the user, said waist strap including a first aperture and a second aperture, said first aperture and said second aperture being integrally mounted on said waist strap wherein said main panel is intermediate thereto, said first aperture and said second aperture being configured to receive a proximate button integrally mounted on the pant;

said waist strap including a first fastener and a second fastener, said first fastener and said second fastener being mounted to said waist strap proximate said first aperture and said second aperture wherein said main panel is intermediate said first fastener and said second fastener, said first fastener and said second fastener being configured to mateably connect to the pant;

said waist strap including a first end and a second end, said first end and said second end being configured to releasably secure to each other subsequent said waist strap being disposed around the waist of the user and journaled through the belt loops of the pant; and a slot, said slot being of appropriate size such that said waist strap can be journaled therethrough, said slot configured to releasably secure said main panel to said waist strap.

5. The pant insert as recited in claim 4, wherein said waist strap is configured to expand in order to accommodate a plurality of waist sizes of the user.

6. The pant insert as recited in claim 5, wherein said waist strap is reversible.

* * * * *